United States Patent [19]

Adachi et al.

[11] 4,115,122

[45] Sep. 19, 1978

[54] INTERNAL LATENT IMAGE SILVER HALIDE EMULSION CONTAINING A HETEROCYCLIC QUATERNARY SALT HAVING A PROPARGYL OR A BUTYRYL CONTAINING SUBSTITUENT

[75] Inventors: Keiichi Adachi; Tadashi Ikeda; Nobuyuki Tsujino, all of Minami Ashigara, Japan

[73] Assignee: Fuji Photo Film Co., Ltd., Minami Ashigara, Japan

[21] Appl. No.: 748,858

[22] Filed: Dec. 9, 1976

[30] Foreign Application Priority Data

Dec. 9, 1975 [JP] Japan ..... 50-146569

[51] Int. Cl.[2] ..... G03C 1/48; G03C 1/06

[52] U.S. Cl. ..... 96/76 R; 96/95; 96/107

[58] Field of Search ..... 96/107, 109, 95, 76 R, 96/64

[56] References Cited

U.S. PATENT DOCUMENTS

| | | | |
|---|---|---|---|
| 3,615,615 | 10/1971 | Lincoln et al. | 96/107 |
| 3,734,738 | 5/1973 | Kurtz et al. | 96/107 |
| 3,764,339 | 10/1973 | Himmelmann et al. | 96/109 |
| 3,910,791 | 10/1975 | von König | 96/109 |
| 3,954,478 | 5/1976 | Arai et al. | 96/107 |

*Primary Examiner*—Won H. Louie, Jr.
*Attorney, Agent, or Firm*—Sughrue, Rothwell, Mion, Zinn and Macpeak

[57] ABSTRACT

A direct positive silver halide photographic light-sensitive material comprising a support having thereon at least one silver halide emulsion layer of the internal latent image type and being capable of forming a direct positive image, in which at least one hydrophilic colloid layer contains at least one heterocyclic quaternary salt compound represented by the following general formula (I)

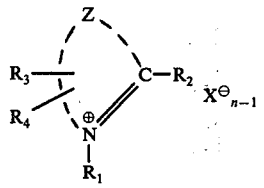

(I)

wherein Z represents an atomic group necessary for forming a 5- or 6-membered heterocyclic nucleus, $R_1$ represents an aliphatic group, $R_2$ represents a hydrogen atom or an aliphatic group, $R_3$ and $R_4$, which may be the same or different, each represents a hydrogen atom, a halogen atom, an aliphatic group, an alkoxy group, a hydroxy group or an aromatic group, and at least one of $R_1$, $R_2$, $R_3$ and $R_4$ represents a propargyl group, a butynyl group or a substituent containing a propargyl or butynyl group, $X\ominus$ represents an anion, $n$ is 1 or 2, with $n$ being 1 in the case that the compound forms an inner salt; in such an amount as to exert a fogging effect on the silver halide emulsion of the internal latent image type.

24 Claims, No Drawings

INTERNAL LATENT IMAGE SILVER HALIDE EMULSION CONTAINING A HETEROCYCLIC QUATERNARY SALT HAVING A PROPARGYL OR A BUTYRYL CONTAINING SUBSTITUENT

BACKGROUND OF THE INVENTION

1. Field of the Invention

This invention relates to a silver halide photographic light-sensitive material which forms a direct positive photographic image, and more particularly, to a photographic light-sensitive material in which a novel compound is contained as a fogging agent in a photographic emulsion layer or another hydrophilic colloid layer(s).

2. Description of the Prior Art

In the field of silver halide photography, photographic processes which can produce photographic images without the formaton of a negative image or without the intermediate treatment for obtaining a negative image are called direct positive photographic processes, and photographic light-sensitive materials and photographic emulsions used in such photographic processes are called direct positive light-sensitive materials and direct positive photographic emulsions, respectively.

Various types of direct positive photographic processes are known, but a process in which previously fogged silver halide grains are exposed to light in the presence of a desensitizer and then developed, and a process in which a silver halide emulsion having sensitivity specks mainly in the interior of the silver halide grains is exposed to light and then developed in the presence of a fogging agent are the most useful. This invention is concerned with the latter process. Silver halide emulsions having sensitivity specks mainly in the interior of silver halide grains and forming a latent image mainly in the interior of the grains are called silver halide emulsions of the internal latent image type.

A method of directly forming a positive image by subjecting a silver halide photographic emulsion of the internal latent image type to surface development in the presence of a fogging agent, and photographic emulsions and light-sensitive materials used in such a method are well known and are described in U.S. Pat. Nos. 2,456,953, 2,497,875, 2,497,876, 2,588,982, 2,592,250, 2,675,318 and 3,227,552, British Pat. Nos. 1,011,062 and 1,151,363, and Japanese Patent Publication 29,405/68.

In the above method of directly forming a positive image, the fogging agent may be added to a developer, but better reversal characteristics can be obtained when the fogging agent is added to a photographic emulsion layer or other layers of the light-sensitive material to adsorb the agent on the surface of the silver halide grains.

Fogging agents which are added to a silver halide emulsion or other layers of a light-sensitive material include the hydrazine compounds described in U.S. Pat. Nos. 2,563,785 and 2,588,982. However, these hydrazine compounds, when added to an emulsion layer, must be used at a quite high concentration (e.g., about 2g per 1 mol of silver). Moreover, since the fogging agent is transferred from the emulsion layer to a developer during development, the concentration of the fogging agent in the emulsion changes, resulting in a variation in maximum density (in the unexposed portions). Further, in multilayer color light-sensitive materials, an unequal fogging effect among the emulsion layers is produced.

Known fogging agents which are free from the above defects include those heterocyclic quaternary salt compounds described in U.S. Pat. Nos. 3,615,615, 3,719,494, 3,734,738 and 3,759,901. However, silver halide emulsions, in many cases, contain a sensitizing dye for spectral sensitization. In particular, for color light-sensitive materials, a layer sensitive to blue light and also layers respectively sensitive to green light and red light are indispensable, and the emulsions of the green-sensitive layer and red-sensitive layer necessarily contain sensitizing dyes.

When a fogging agent together with a sensitizing dye for green light or red light are incorporated into a direct positive emulsion, competitive adsorption on the silver halide occurs between the sensitizing dye and the quaternary salt fogging agent. Therefore, when the fogging agent is employed in an amount necessary for forming the desired nuclei, spectral sensitization is inhibited, and on the other hand, when the spectrally sensitizing dye is used in a concentration sufficient to obtain the desired spectral sensitization, the formation of fog nuclei is inhibited.

The use of a sensitizing dye containing, in the dye molecule, a substituent having a fogging (nucleating) effect as described in U.S. Pat. No. 3,718,470 is known as a method of overcoming the above defect.

However, this method of making a single molecule have a fogging effect and a spectral sensitizing effect is disadvantageous, e.g., in that the use of an amount adequate for spectral sensitization results in an unsatisfactory fogging effect, and on the other hand, the use of a sufficient amount to produce a fogging effect is unsuitable for spectral sensitization.

To solve the above problems, fogging agents which are more readily adsorbed on silver halide and perform the desired formation of nuclei by their use in such an amount which does not inhibit spectral sensitization are required.

SUMMARY OF THE INVENTION

A first object of this invention is to provide a direct positive light-sensitive material which can produce a uniform maximum density.

A second object of this invention is to provide a direct positive light-sensitive material containing a fogging agent which exhibits the desired fogging effect without inhibiting spectral sensitization.

Another object of this invention is to provide a direct positive photographic light-sensitive material which can be spectrally sensitized sufficiently and with which a direct positive image having a uniform and high maximum density can be formed.

A further object of this invention is to provide a direct positive photographic light-sensitive material which does not contaminate a developer on development.

The above objects of this invention are attained by incorporating into at least one hydrophilic colloid layer of a silver halide light-sensitive material containing at least one silver halide photographic emulsion layer of the internal latent image type, preferably into a silver halide photographic emulsion layer of the internal latent image type or a hydrophilic colloid layer adjacent thereto, a heterocyclic quaternary salt compound represented by the following general formula (I)

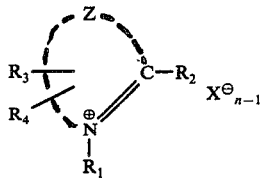

(I)

wherein Z represents an atomic group necessary for forming a 5- or 6-membered heterocyclic nucleus, $R_1$ represents an aliphatic group, $R_2$ represents a hydrogen atom or an aliphatic group, $R_3$ and $R_4$, which may be the same or different, each represents a hydrogen atom, a halogen atom, an aliphatic group, an alkoxy group, a hydroxy group or an aromatic group, at least one of $R_1$, $R_2$, $R_3$ and $R_4$ being a propargyl group, a butynyl group or a substituent containing a propargyl or butynyl group, $X\ominus$ represents an anion, $n$ is 1 or 2, with $n$ being 1 when the compound forms an inner salt; in an amount sufficient to exert a fogging effect on the silver halide photograhic emulsion of the internal latent image type.

DETAILED DESCRIPTION OF THE INVENTION

Examples of heterocyclic nuclei which are completed by Z include, for example, a thiazoline nucleus, a thiazole nucleus, a benzothiazole nucleus, a naphthothiazole nucleus, a selenazole nucleus, a benzoselenazole nucleus, a naphthoselenazole nucleus, an oxazoline nucleus, an oxazole nucleus, a benzoxazole nucleus, a naphthoxazole nucleus, a benzimidazole nucleus, a pyridine nucleus, a quinoline nucleus, a tetrazole nucleus, an indolenine nucleus, etc.

specific examples of the above nuclei are thiazolines such as 2-methyl-2-thiazoline, 2-p-hydroxyphenyl-5-methyl-2-thiazoline, 2-phenyl-2-thiazoline, 2-ethyl-2-thiazoline, 2-propyl-2-thiazoline and 2-thiazoline; thiazoles such as thiazole, 4-methylthiazole, 4-phenylthiazole, 4-(p-hydroxyphenyl)thiazole, 5-methylthiazole, 5-phenylthiazole, 4,5-dimethylthiazole and 4,5-diphenylthiazole; benzothiazoles such as benzothiazole, 5-hydroxybenzothiazole, 5-fluorobenzothiazole, 5-chlorobenzothiazole, 6-chlorobenzothiazole, 5-methylbenzothiazole, 6-methylbenzothiazole, 5,6-dimethylbenzothiazole, 5-bromobenzothiazole, 5-phenylbenzothiazole, 6-phenylbenzothiazole, 5-methoxybenzothiazole, 6-methoxybenzothiazole, 5-iodobenzothiazole, 5-ethoxybenzothiazole, tetrahydrobenzothiazole, 5,6-dimethoxybenzothiazole, 5-hydroxybenzothiazole and 6-hydroxybenzothiazole; naphthothiazoles such as $\alpha$-naphthothiazole, $\beta$-naphthothiazole, $\beta,\beta$-naphthothiazole, 5-methoxy-$\beta$-naphthothiazole, 5-ethoxy-$\beta$-naphthothiazole, 7-methoxy-$\alpha$-naphthothiazole, 5-hydroxy-$\beta$-naphthothiazole, 7-hydroxy-$\alpha$-naphthothiazole and 5-ethyl-$\beta$-naphthothiazole; selenazoles such as selenazole, 4-methylselenazole and 4-phenylselenazole; benzoselenazoles such as benzselenazole, 5-chlorobenzoselenazole, 5-methoxybenzoselenazole, 5-hydroxybenzoselenazole and tetrahydrobenzoselenazole; naphthoselenazoles such as $\alpha$-naphthoselenazole, $\beta,\beta$-naphthoselenazole and $\beta$-naphthoselenazole; oxazolines such as 2-oxazoline, 2-phenyl-5-methyl-2-oxazoline, 2-methyl-2-oxazoline, 2-phenyl-5-carboethoxy-2-oxazoline and 2-phenyl-4-hydroxymethyl-2-oxazoline; oxazoles such as oxazole, 4-methyloxazole, 5-methyloxazole, 4-phenyloxazole, 4,5-diphenyloxazole, 4-ethyloxazole, 4,5-dimethyloxazole and 5-phenyloxazole; benzoxazoles such as benzoxazole, 5-chlorobenzoxazole, 5-methylbenzoxazole, 5-phenylbenzoxazole, 6-methylbenzoxazole, 5,6-dimethylbenzoxazole, 5-methoxybenzoxazole, 5-ethoxybenzoxazole, 5-trifluoromethylbenzoxazole, 5-hydroxybenzoxazole and 6-hydroxybenzoxazole; naphthoxazoles such as $\alpha$-naphthoxazole, $\beta,\beta$-naphthoxazole, $\beta$-naphthoxazole and 7-hydroxy-$\beta$-naphthoxazole; benzimidazoles such as benzimidazole, 1-ethylbenzimidazole, 1-ethyl-5-chlorobenzimidazole, 1-ethyl-5,6-dichlorobenzimidazole and 1-phenyl-5,6-dichlorobenzimidazole; tetrazoles such as tetrazole, 1-phenyltetrazole, 2-phenyltetrazole, 5-bromotetrazole, 1,5-dimethyltetrazole, pentamethylenetetrazole, 1-carboethoxytetrazole and 1-methyl-5-phenyltetrazole; pyridines such as pyridine, 3-ethylpyridine, 4-decylpyridine, 4-benzylpyridine, 4-phenylpyridine, 4-chloropyridine, 4-bromopyridine, 4,6-dichloropyridine, 6-bromopyridine, 4-methoxypyridine, 4-ethoxypyridine and 6-methoxypyridine; quinolines such as quinoline, 3-methylquinoline, 6-methylquinoline, 8-methylquinoline, 6-chloroquinoline, 8-chloroquinoline, 8-fluoroquinoline, 6-metoxyquinoline, 6-ethoxyquinoline, 6-hydroxyquinoline and 8-hydroxyquinoline; and indolenines such as indolenine, 3,3-dimethylindolenine, 5-hydroxy-3,3-dimethylindolenine, 3,3-dimethyl-6-chloroindolenine and 3,3,5-trimethylindolenine.

Aliphatic groups represented by $R_1$ include unsubstituted alkyl groups having 1 to 18 carbon atoms (e.g., methyl, ethyl, isopropyl, n-butyl, t-butyl, heptadecyl, etc.) and substituted alkyl groups having 1 to 4 carbon atoms in the alkyl moiety with the total number of carbon atoms being 1 to 18 such as sulfoalkyl groups (e.g., 2-sulfoethyl, 3-sulfopropyl, 3-sulfobutyl, 2-hydroxy-3-sulfopropyl, $\delta$-sulfobutyl, etc.), carboxyalkyl groups (e.g., 2-carboxyethyl, 4-carboxybutyl, carboxymethyl, etc.), hydroxyalkyl groups (e.g., 2-hydroxyethyl, 3-hydroxypropyl, etc.), alkoxyalkyl groups including substituted alkoxyalkyl groups (e.g., 2-methoxyethyl, 3-methoxypropyl, 2-(2-sulfoethoxy)ethyl, 2-[2-(3-sulfopropoxy)ethoxy]-ethyl, hydroxymethoxymethyl, 2-hydroxyethoxymethyl, 2-(2-hydroxyethoxy)ethyl, 2-(2-acetoxyethoxy)ethyl, acetoxymethoxymethyl, etc.), acyloxyalkyl groups (e.g., 2-acetoxyethyl, 4-propionyloxybutyl, etc.), dialkylaminoalkyl groups (e.g., dimethylaminoethyl, diethylaminopropyl, etc.), sulfatoalkyl groups (e.g., $\beta$-sulfatoethyl, 4-sulfatobutyl, etc.), aralkyl groups (e.g., benzyl, phenethyl, p-sulfobenzyl, etc.), alkenyl groups (e.g., vinylmethyl) and alkynyl groups (e.g., propargyl, 3-butynyl, etc.).

Aliphatic groups represented by $R_2$ include unsubstituted alkyl groups having 1 to 18 carbon atoms (e.g., methyl, ethyl, isopropyl, n-butyl, t-butyl, etc.) and substituted alkyl groups having 1 to 4 carbon atoms in the alkyl moiety with the total number of carbon atoms being 1 to 18 such as sulfoalkyl groups (e.g., 2-sulfoethyl, 3-sulfopropyl, 3-sulfobutyl, 4-sulfobutyl, 2-hydroxy-3-sulfopropyl, etc.), carboxyalkyl groups (e.g., 2-carboxyethyl, 4-carboxybutyl, carboxymethyl, etc.), hydroxyalkyl groups (e.g., 2-hydroxyethyl, 3-hydroxypropyl, etc.), alkoxyalkyl groups including substituted alkoxyalkyl groups (e.g., $\beta$-methoxyethyl, $\gamma$-methoxypropyl, 2(2-sulfoethoxy)ethyl, 2[2-(3-sulfopropoxy)ethoxy]ethyl, hydroxymethoxymethyl, 2-hydroxyethoxymethyl, 2-(2-hydroxyethoxy)ethyl, 2(2-acetoxyethoxy)ethyl, acetoxymethoxymethyl, propargyloxymethyl, etc.), acyloxyalkyl groups (e.g., 2-acetoxyethyl, 4-propionyloxybutyl, etc.), dialkylaminoalkyl groups (e.g., dimethylaminoethyl, diethylaminopropyl, etc.), sulfatoalkyl groups (e.g., 2-sulfatoethyl, 4-sulfatobutyl, etc.), aralkyl groups (e.g,, benzyl, phenethyl, p-sulfobenzyl, etc.), alkenyl groups (e.g., vinylmethyl), alkynyl groups (e.g., propargyl, 3-butynyl, etc.) and alkyl grops substituted with a heterocyclic ring (e.g., 4-(3'propargylbenzothiazol-2-yl)butyl, etc.).

Examples of halogen atoms represented by $R_3$ and $R_4$ include, for example, a chlorine atom, a bromine atom, an iodine atom, etc.

The aliphatic groups respectively represented by $R_3$ and $R_4$ include unsubstituted alkyl groups having 1 to 18 carbon atoms (e.g., methyl, ethyl, i-propyl, n-butyl, t-butyl, heptadecyl, etc.) and substituted alkyl groups having 1 to 4 carbon atoms in the alkyl moiety with the total number of carbon atoms being 1 to 18 such as sulfoalkyl groups (e.g., 2-sulfoethyl, 3-sulfopropyl, 3-sulfobutyl, 4-sulfobutyl, 2-hydroxy-3-sulfopropyl, etc.), carboxyalkyl groups (e.g., 2-carboxyethyl, 4-carboxybutyl, carboxymethyl, etc.), hydroxyalkyl groups (e.g., β-hydroxyethyl, γ-hydroxypropyl, etc.), alkoxyalkyl groups including substituted alkoxyalkyl groups (e.g., β-methoxyethyl, γ-methoxypropyl, propargyloxymethyl, 2-propargyloxyethyl, 2-(2-sulfoethoxy)ethyl, 2-[2-(3-sulfopropoxy)ethoxy]ethyl, hydroxymethoxymethyl, 2-hydroxyethoxymethyl, 2-(2-hydroxyethoxy)ethyl, 2-(2-acetoxyethoxy)ethyl, acetoxymethoxymethy, etc.). acyloxyalkyl groups (e.g., 2-acetoxyethyl, 4-propionyloxybutyl, etc.), dialkylaminoalkyl groups (e.g., dimethylaminoethyl, diethylaminopropyl, etc.), haloalkyl groups (e.g., trifluoromethyl), sulfatoalkyl groups (e.g., β-sulfatoethyl, ω-sulfatobutyl, etc.), aralkyl groups (e.g, benzyl, phenethyl, p-sulfobenzyl, etc.), alkenyl groups (e.g., vinylmethyl) and alkynyl groups (e.g., propargyl, 3-butynyl, etc.).

The aromatic groups represented by $R_3$ and $R_4$ include monocyclic or bicyclic aryl groups, preferably monocyclic aryl groups, e.g., unsubstituted aryl groups with the number of carbon atoms being up to 18 (e.g., phenyl, naphthyl, etc.) and substituted aryl groups (e.g., phenyl groups containing one or more substituents such as an alkyl group having 1 to 4 carbon atoms (e.g., methyl), an alkoxy group having 1 to 4 carbon atoms (e.g., methoxy, ethoxy, etc.), a hydroxy group, a halogen atom (e.g., chlorine atom) or sulfo grop), the total number of carbon atoms of the substituted aryl groups ranging up to 18. Specific examples of these groups are a p-tolyl group, a p-methoxyphenyl group, a p-hydroxyphenyl group, a 2,4-dimethoxyphenyl group, a p-chlorophenyl group and a p-sulfophenyl group.

$R_3$ and $R_4$ can also represent an alkoxy group having 1 to 18 carbon atoms, i.e., an unsubstituted alkoxy group (such as methoxy, ethoxy or propargyloxy) or a substituted alkoxy group (such as benzyloxy or α-naphthylmethyloxy), or a hydroxy group.

Specific examples of $X^{\ominus}$ are a chloride ion, a bromide ion, an iodide ion, a p-toluenesulfonate ion, an ethylsulfonate ion, a perchlorate ion and a thiocyanate ion.

*n* is 1 when the compound represented by the general formula (I) forms an inner salt, and in other cases, *n* is 2.

Specific examples of the useful compounds in this invention are given below.

1. 3-Propargylbenzothiazolium bromide
2. 5,6-Dimethyl-3-propargylbenzothiazolium bromide
3. 5-Methoxy-6-methyl-3-propargylbenzothiazolium bromide
4. 2-Methyl-3-propargylbenzothiazolium bromide
5. 5-Chloro-2-methyl-3-propargylbenzothiazolium bromide
6. 2-Methyl-6-methoxy-3-propargylbenzothiazolium bromide
7. 2-Methyl-3-propargylnaphtho[1,2-d]thiazolium bromide
8. 2-Methylthio-3-propargylbenzothiazolium bromide
9. 2-Methyl-3-propargyl-5-propargyloxybenzothiazolium bromide
10. 1,4-bis(3-Propargylbenzothiazolium-2(butane dibromide
11. 2-Ethyl-3-propargylbenzothiazolium bromide
12. 3-Methyl-2-propargyloxymethylbenzothiazolium iodide
13. 3-Propyl-2-propargyloxymethylbenzothiazolium chloride
14. 2,3-Dimethyl-5-propargyloxybenzothiazolium iodide
15. Anhydro-2-methyl-5-propargyloxy-3-sulfopropylbenzothiazolium bromide
16. 2-Methyl-5-propargyloxy-3-propylbenzothiazolium chloride
17. 2-Methyl-6-α-naphthylmethoxy-1-propargylquinolinium bromide
18. 2,6-Dimethyl-3-propargylbenzothiazolium bromide
19. 5,6-Dichloro-1-ethyl-2-methyl-3-propargylbenzimidazolium bromide
20. 2-Propyl-3-propargylbenzothiazolium bromide
21. 3-(3-Butynyl)benzothiazolium thiocyanate
22. 2,4-Dimethyl-3-propargylthiazolium bromide
23. 2-Methoxy-4-methyl-3-propargylthiazolium bromide
24. 2-Methyl-3-propargylthiazolinium iodide
25. 2,4-Dimethyl-3-propargyloxazolium iodide
26. 2,5-Methyl-4-carbomethoxy-3-propargyloxazolium iodide
27. 2-Methyl-4-phenyl-3-propargyloxazolium iodide
28. 2-Methyl-4,5-diphenyl-3-propargyloxazolium iodide
29. 2-Methyl-5-phenyl-3-propargylbenzoazolium bromide
30. 2-Methyl-5-trifluoromethyl-3-propargylbenzoxazolium bromide
31. 2-Methyl-5-chloro-3-propargylbenzoxazolium bromide
32. 2,3,3-Trimethyl-1-propargylindoleninium chloride
33. 2-Methyl-1-propargylpyridinium chloride
34. 2-Methyl-3-propargylbenzoselenazolium bromide
35. 2-Propargyloxymethyl-3-methylbenzoselenazolium bromide
36. 2-Methyl-3-propargyl-5-propargyloxybenzoselenazolium bromide
37. 5-Methyl-1-propargyltetrazolium bromide The heterocyclic quaternary salts of this invention can easily be prepared by reacting a corresponding heterocyclic compound wth a corresponding alkylating reagent. Typical alkylating reagents include, for example, methyl iodide, ethyl bromide, propyl chloride, propargyl bromide, propanesultone, methyl p-toluenesulfonate, etc.

This reaction requires no catalyst and proceeds by heating at about 50° to about 140° C for about 30 minutes to several hours. Solvents such as alcohols (e.g., methyl alcohol, ethyl alcohol, etc.), acetone, methyl ethyl ketone, benzene or toluene are useful, but the reaction can also be carried out without any solvent. Since the reaction product precipitates, a pure compound can be obtained simply by washing with a solvent, e.g., as described above.

Examples of the synthesis of the heterocyclic quaternary salts of this invention are set forth below.

Unless otherwise indicated in the Examples, all parts, percents, ratios and the like are by weight.

SYNTHESIS EXAMPLE 1

3-Propargylbenzothiazolium Bromide 13.5 g of benzothiazole was mixed with 13.1 g of propargyl bromide. The mixture was heated at 80° to 100° C for one hour on a hot water bath to solidify it. After cooling to room temperature (about 20°- 30° C), the solid was washed with acetone to give 21 g of 3-propargylbenzothiazolium bromide, m.p. 209°- 210° C.

SYNTHESIS EXAMPLE 2

2-Methyl-3-propargylbenzothiazolium Bromide 14.9 g of 2-methylbenzothiazole and 12.5 g of propargyl bromide were heated at 80 to 100° C on a hot water bath for 3 hours. The precipitated crystals were washed with acetone to obtain 18.5 g of 2-methyl-3-propargylbenzothiazolium bromide, m.p. 214°- 215° C.

SYNTHESIS EXAMPLE 3

2-Methyl-3-propargyl-5-propargyloxybenzothiazolium Bromide 20.4 g of 2-methyl-5-propargyloxybenzothiazole and 12.5 g of propargyl bromide were heated on a hot water bath at 80° to 100° C for 3 hours. The precipitated crystals were washed with acetone to give 17.5 g of 2-methyl-3-propargyl-5-propargyloxybenzothiazolium bromide, m.p. 244° C.

Fogging agents, in general, are reducing compounds like a developing agent used for the development of a silver halide emulsion. One known means of determining the strength of their reducibility is the measurement of the polarographic have-wave potential.

Of the fogging agents used in this invention, fogging agents which exhibit a cathodic half-wave potential more negative than −250 mV (VS.SCE) under normal development conditions, i.e., at a pH of 11.5, are more effective. However, this is subject to considerable exceptions, and the degree of the effect can not, therefore, be judged only by the polarographic half-wave potential.

The heterocyclic quaternary salt compound represented by the general formula (I) is incorporated preferably into a silver halide emulsion of the internal latent image type in the direct positive light-sensitive material of this invention, but the compound can also be incorporated into a hydrophilic colloid layer adjacent the silver halide emulsion layer of the internal image type. Such an adjacent layer may be layers having any function, e.g., a light-sensitive layer, an intermediate layer, a filter layer, a protective layer, an antihalation layer, etc.

The desirable amount of the quaternary salt compound present in the layer is that amount which will provide a sufficient maximum density (e.g., 2.0 or more) when the emulsion of the internal latent image type is developed in a surface developer. In practice, the amount can widely vary depending on the characteristics of the silver halide emulsion used, the type of the fogging agent utilized and the development conditions employed, but an amount ranging from about 5 mg to about 1000 mg per mol of silver in the silver halide emulsion of the internal latent image type is useful, and an amount of about 15 mg to about 700 mg per mol of silver is preferred. In incorporating the heterocyclic quaternary salt compound of this invention into a hydrophilic colloid layer adjacent the emulsion layer, the same amount as above can be employed based on the amount of silver contained in an equal area of the emulsion of the internal latent image type.

The emulsions of the internal latent image type which can be used in this invention include silver halide emulsions which form a latent image mainly in the interior of the silver halide grains, and are distinguished from silver halide grains which form a latent image mainly on the surface of the grains. Such an internal latent image is already disclosed in U.S. Pat. No. 2,592,250 and also in the literature. The silver halide emulsion of the internal latent image type can be clearly defined as one which when developd in an "internal" developer, gives a maximum density higher than that attained when developed in a "surface" developer. Surface developers and internal developers are described in detail in G. Kornfeld, "The Distribution of the Latent Image in the Silver Bromide Grain" *J. Opt. Soc.*, 31, 598 (1941), W. F. Berg, A. Marrige and G. W. W. Stevens, "Latent Image Distribution" *Phot. J.*, 81 413 (1941), G. W. W. Stevens, "The Depth of Internal Latent Image" *J. Photographic Sci.*, 1 122 (1953), R. V. Dyba and T. D. Smith, "Effect of Developers and of pH in the Latent Image Distribution Studies" *Phot. Sci. Eng.*, 7 98 (1956) and E. Moisar and S. Wagner, "Untersuchungen uber die Topographie des latenten Innen- and Aussenbildes" *Ber. der Bunsengesselschaft physk. Chem.* 67 356 (1963).

Regarding the emulsions of the internal latent image type suitable for this invention, a maximum density obtained when the silver halide emulsion is coated on a transparent support, exposed to light for a fixed time ranging from 0.01 to 1 sec and then developed at 20° C for 3 minutes in the following Developer A (internal developer) is at least 5 times higher than that obtained when the silver halide emulsion exposed to light in the same manner as above is developed at 20° C for 4 minutes in the following Developer B (surface developer), as measured according to the usual measurement of photographic density.

| Developer A | |
|---|---|
| Hydroquinone | 15 g |
| Monomethyl-p-aminophenol Sesquisulfate | 15 g |
| Sodium Sulfite | 50 g |
| Potassium Bromide | 10 g |
| Sodium Hydroxide | 25 g |
| Sodium Thiosulfate | 20 g |
| Water to make | 1 liter |

| Developer B | |
|---|---|
| p-Oxyphenylglycine | 10 g |
| Sodium Carbonate | 100 g |
| Water to make | 1 liter |

The emulsions described in U.S. Pat. No. 2,592,250 described above, and the emulsions described in British Pat. No. 1,027,146 and U.S. Pats. Nos. 3,206,313, 3,511,662, 3,447,927, 3,737,313 and 3,271,157 can be used as the emulsion of the internal latent image type suitable for the objects of this invention. However, the invention is not restricted to these.

More specifically, an emulsion of the internal latent image type for use in this invention can be prepared as follows:

(1) Halide conversion emulsion

First, a silver chloride emulsion is precipitated, and then a halide exchange is effected by introducing bromide and optionally some iodide salts.

Increased speed can be obtained by adding noble metal salts before the completion of the conversion step (e.g., as described in U.S. Pat. 3,703,584). Some additional improvement can be attained by sulfur- and gold-sensitizing the silver chloride emulsion, converting with bromide or iodo-bromide and then lightly sulfur- and gold-sensitizing the surface.

(2) Double-jet precipitation of silver bromide or silver iodo-bromide. The formation of internal sensitivity specks is promoted by the rapid introduction of thiocyanate after about 20 - 35% of the emulsion has been precipitated.

(3) Silver halide grains having foreign ion dopants occluded therein, with the grains having been chemically sensitized on the surface to a level less than that which will produce a substantial density in a surface developer after a normal imagewise exposure to light.

The dopant is a foreign metal ion or a metal or inorganic nonmetal compound. The term "foreign metal ion" is used to describe an ion other than a silver ion. Examples of dopants are metallic silver, iridium, gold, platinum, etc.

Precipitation in the presence of the metal ion or preferably despositing the metal (i.e., chemically sensitizing) on a core of silver halide is conducted and then formation of the grain to build a shell or outer region over the metallic deposit is continued.

In the direct positive photographic material of this invention, various colloids can be used as a binder.

Examples of colloids used for this purpose include any hydrophilic colloid generally used in photographic art, for example, gelatin, colloidal albumin, polysaccharides, cellulose derivatives, synthetic resins such as polyvinyl compounds including polyvinyl alcohol derivatives or acrylamide polymers, etc. The vehicle or binder can contain, in addition to the hydrophilic colloid, a hydrophobic colloid such as dispersed vinyl compound polymers, particularly, those which can increase dimensional stability of the photographic material. Suitable compounds of this type include water-soluble polymers such as alkyl acrylate, alkyl methacrylate, acrylic acid, sulfoalkyl acrylate or sulfoalkyl methacrylate.

Various supports can be used in the light-sensitive material of this invention. The silver halide emulsion can be coated on one side or both sides of the support. Typical examples of supports are cellulose nitrate film, cellulose aliphatic acid ester film, polyvinyl acetal film, polystyrene film, polyethylene terephthalate film and other polyesters, glass, papers, metals and ceramics. Satisfactory results can also be obtained with supports such as papers coated with an $\alpha$-olefin polymer, particularly, a polymer of an $\alpha$-olefin containing 2 or more carbon atoms, such as polyethylene, polypropylene or an ethylene butene copolymer.

The photographic silver halide emulsion layer and other hydrophilic colloid layers of the light-sensitive material of this invention can be hardened with any suitable hardener. Examples of suitable hardeners are aldehyde hardeners such as formaldehyde or mucohalic acids, hardeners containing an active halogen, dioxane derivaties and oxypolysaccharides such as oxy-starch.

Other additives, particularly those which are known to be useful in a photographic emulsion, such as a lubricant, a stabilizer, a sensitizer, a light-absorbing dye and a plasticizer can be added to the photographic silver halide emulsion layer.

Moreover, in this invention, a compound which releases iodide ions (such as potassium iodide) can be incorporated in the silver halide emulsion, or a developer containing iodide ions can be used to obtain the desired image.

The light-sensitive material of this invention can contain a surface active agent for various purposes. Any nonionic, ionic and amphoteric surface active agents can be used depending upon the purpose, and examples of them are polyoxyalkylene derivatives and amphoteric amino acids (including sulfobetaines). Such surface active agents are described in U.S. Pats. Nos. 2,600,831, 2,171,622, 2,271,623, 2,275,727, 2,787,604, 2,816,920 and 2,739,891, and Belgian Pat. No. 652,862.

The photographic emulsion of the light-sensitive material of this invention can be spectrally sensitized as to blue light of a comparatively longer wavelength, green light, red light or infrared light by using sensitizing dyes. Cyanine dyes, merocyanine dyes, complex cyanine dyes, complex merocyanine dyes, holopolar cyanine dyes, styryl dyes, hemicyanine dyes, oxonol dyes, hemioxonol dyes, and the like can be used as sensitizing dyes. Cyanine type dyes can have, as a basic nucleus, any of nitrogen-containing heterocyclic rings such as pyrroline, oxazoline, thiazoline, pyrrole, oxazole, thiazole, selenazole, imidazole, pyridine or tetrazole. The nitrogen atom in these nuclei can have, as substituents, an aliphatic group such as an alkyl group, an alkenyl group, an alkylene group, a hydroxyalkyl group, a carboxylalkyl group, a sulfoalkyl group, an aminoalkyl group, an alkoxyalkyl group, a sulfohydroxy-alkyl group or a sulfoalkoxyalkyl group. Moreover, these nuclei can be condensed with an aromatic ring (e.g., a benzene ring, a naphthalene ring, etc.) unsubstituted or substituted with a halogen atom, an alkyl group, an alkoxy group, a hydroxy group, a cyano group, a carboxy group, an alkoxycarbonyl group, an alkylamino group, a dialkylamino group, an acylamino group, an acyl group, a phenyl group or a fluoroalkyl group, an alicyclic hydrocarbon ring (e.g., cyclohexene ring) unsubstituted or substituted with the above atoms or groups or heterocyclic ring (e.g., a quinoxaline ring, a quinoline ring, a pyridine ring, etc.) unsubstituted or substituted with the above atoms or groups. The cyanine dyes may be symmetric or asymmetric, and the methine or polymethine chain thereof can be substituted with an alkyl group, a phenyl group, a substituted phenyl group such as a carboxyphenyl group or a heterocyclic nucleus such as a furyl group or a thienyl group. In addition, a part of the methine chain can form a 5- or 6-membered ring in conjunction with other atoms. Merocyanine dyes which can be used are those having the above basic nucleus and an acidic nucleus such as a 2-thiaoxazolidinedione nucleus, a rhodanine nucleus, a thiohydantoin nucleus, a barbituric acid nucleus, a thiobarbituric acid nucleus or a pyrazolone nucleus. The nitrogen atom or a carbon atom in the above acidic nuclei can be substituted with an alkyl group, an alkylene group, a phenyl group, a hydroxyalkyl group, a carboxyalkyl group, a sulfoalkyl group, an alkoxyalkyl group, an aminoalkyl group, an acylamino group or a heterocyclic nucleus (e.g., a furfuryl group). These sensitizing dyes can be used individually or as a combination thereof. A large number of combinations of sensitizing dyes are known which are used for supersensitization, and they can be used in this invention as well.

Useful sensitizing dyes which can be used in this invention are described, e.g., in U.S. Pat. Nos. 3,552,052, 3,619,197, 3,713,828, 3,615,643, 3,615,632, 3,617,293, 3,627,964, 3,703,377, 3,666,480, 3,667,960, 3,679,428, 2,672,897, 3,679,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, Japanese Patent (OPI) Application No. 76,525/73, Belgian Pat. No. 691,807, etc.

The sensitizing dyes used in this inventon are used in an amount equal to that used in a conventional negative silver halide emulsion. In particular, it is advantageous to use a dye amount such that the inherent sensitivity of the silver halide emulsion is not substantially reduced. Use of the sensitizing dye in an amount of about $10 \times 10^{-5}$ to about $5 \times 10^{-4}$ mol, particularly about $4 \times 10^{-4}$ mol, per mol of silver halide is preferred.

The optimum amount of the sensitizing dye can be determined by dividing the emulsion into a number of portions, incorporating different amounts of the sensitizing dye into the portions and then measuring the spectral sensitivity of each of the portions, using methods known by those skilled in the art.

The addition of the sensitizing dye to the emulsion can be carried out by methods well known in the photographic art.

These sensitizing dyes can be directly dispersed in the emulsion. Alternatively, they can be added to the emulsion in the form of a solution thereof which is made by initially dissolving the dyes in a water-miscible solvent such as pyridine, methyl alcohol, ethyl alcohol, methyl Cellosolve, acetone or mixtures thereof and then, in some cases, diluting with water, or by dissolving the dyes in water alone, in some cases. For this dissolution, ultrasonic vibration can be used. In addition, the methods as described in Japanese Patent Publications Nos. 8,231/70, 23,389/69, 27,555/69 and 22,948/69, German Patent Application (OLS) 1,947,935, and U.S. Pat. Nos. 3,485,634, 3,342,605 and 2,912,343 can also be used.

As required, the sensitizing dyes can be separately dissolved in suitable solvents and then seaprately added to the emulsion, or the dyes can be dissolved respectively in the same or different solvents and then the solutions obtained are mixed before addition to the silver halide emulsion.

The light-sensitive material of this invention can contain color image-forming couplers. Alternatively, it can be developed in a developer containing color image-forming couplers. Any known method can be employed in adding the couplers to the silver halide emulsion of this invention. For example, the methods as described in U.S. Pat. Nos. 1,055,155, 1,102,028, 2,186,849, 2,322,027 and 2,801,171 can be used. In this invention, a developing agent such as a polyhydroxybenzene, an aminophenol or a 3-pyrazolidone can be incorporated into the emulsion or the light-sensitive material. The photographic emulsion of this invention may be unhardened and may contain a tanning development agent such as hydroquinone or catechol.

The photographic emulsion of this invention can be used in combination with a color image-forming substance used for diffusion transfer which releases a diffusable dye according to the development of silver halide to obtain the desired transferred image in a receiving material after suitable development. Many color image-forming substances used for diffusion transfer are known, and those as described in U.S. Pat. Nos. 3,227,551, 3,227,554, 3,443,939, 3,443,940, 3,658,524, 3,698,897, 3,725,062, 3,728,113 and 3,751,406, British Pat. Nos. 840,731, 904,364 and 1,038,331, German Patent Applications (OLS) Nos. 1,930,215, 2,214,381, 2,228,361, 2,242,762, 2,317,134, 2,402,900, 2,406,626 and 2,406,653, and Japanese Patent Applications (OPI) No. 114,424/74 can be used.

Various known developing agents can be used for developing the light-sensitive material of this invention. That is, polyhydroxybenzenes such as hydroquinone, 2-chlorohydroquinone, 2-methylhydroquinone, catechol or pyrogallol; aminophenols such as p-aminophenol, N-methyl-p-aminophenol or 2,4-diaminophenol; 3-pyrazolidones such as 1-phenyl-3-pyrazolidones, e.g., 4,4-dimethyl-1-phenyl-3-pyrazolidone, 5,5-dimethyl-1-phenyl-3-pyrazolidone, etc.; ascorbic acids; and the like can be used individually or as a combination thereof. Moreover, in order to form a dye image in the presence of a dye-forming coupler, aromatic primary amine developing agents, preferably p-phenylenediamine developing agents, can be used. Specific examples of aromatic primary amine developing agents are 4-amino-3-methyl-N,N-diethylaniline hydrochloride, N,N-diethyl-p-phenylenediamine, 3-methyl-4-amino-N-ethyl-N-$\beta$-(methane-sulfoamide)ethylaniline, 3-methyl-4-amino-N-ethyl-N-($\beta$-sulfoethyl)-aniline, 3-ethoxy-4-amino-N-ethyl-N-($\beta$-sulfoethyl)-aniline and 4-amino-N-ethyl-N-($\beta$-hydroxyethyl)-aniline. These developing agents can be incorporated in the light-sensitive material of this invention (e.g., the emulsion layer).

The developer can contain a preservative such as sodium sulfite, potassium sulfite, ascorbic acid, reductones (e.g., piperidinohexose reductone).

A direct positive image can be formed when the light-sensitive material of this invention is developed in a surface developer. A surface developer is one in which developement is substantially induced by a latent image or fog nuclei on the surface of silver halide grains. Preferably, the developer contains no silver halide solvent, for example, thiocyanates. However, as long as the internal latent image does not substantially contribute to the development centers of the silver halide grains is completed, a silver halide solvent (such as sulfite) can be present to some extent, for example, 5 to 10 g/l of sodium sulfite.

The developer can contain an alkali agent and a buffer such as sodium hydroxide, potassium hydroxide, sodium carbonate, potassium carbonate, trisodium phosphate or sodium metaphosphate. The amounts of these agents present are selected so as to adjust the pH of the developer to about 10 to about 13, preferably 11 to 12.5.

The quaternary salt fogging agent used in this invention can also be present in the developer. In this case, amounts ranging from about 0.05 to about 5 g are useful per liter of the developer. More preferred results are obtained with amounts ranging from 0.1 g to 1 g.

The developer can contain a color development accelerator such as benzyl alchohol. To reduce the minimum density of the direct positive image, it is advantageous to incorporate a compound generally used as an antifogging agent, for example, benzimidazoles such as 5-nitrobenzimidazole; benzotriazoles such as benzotriazole or 5-methyl-benzotriazole; etc.

The light-sensitive material of this invention can be treated with a viscous developer. A viscous developer can contain a hydrophilic polymer such as a high molecular weight polyvinyl alcohol, hydroxyethyl cellulose, xanthane rubber or sodium carboxymethyl cellulose. These polymers are used in such an amount so as to provide a developer viscosity of about 100 centipoise or more, preferably 100 to 1000 poise, at room temperature (about 20° – 30° C).

The temperature for development can be varied widely from about 10° to about 40° C. The development time can be varied from several seconds to about 30 minutes, depending on the processing temperature, in order to obtain the desired sensitometric characteristics.

The following example is given to illustrate this invention in greater detail. However, the invention is not to be construed as being limited thereto.

EXAMPLE

A silver halide emulsion of the internal latent image type was prepared in the following manner according to the halogen-conversion method as described in U.S. Pat. No. 2,592,250.

| Solution No. 1 (prepared at 50° C) | |
|---|---|
| Inert Gelatin | 20 g |
| Sodium Chloride | 3.5 g |
| Water | 2000 cc |

| Solution No. 2 (prepared at 40° C) | |
|---|---|
| Sodium Chloride | 70 g |
| Water | 520 cc |

| Solution No. 3 (prepared at 40° C) | |
|---|---|
| Silver Nitrate | 200 g |
| Ammonia (25% aq. soln.) | 2.00 cc |
| Water | 400 cc |

| Solution No. 4 (prepared at 45° C) | |
|---|---|
| Potassium Bromide | 160 g |
| Potassium Iodide | 20 g |
| Water | 500 cc |

Solutions No. 2 and No. 3 were simultaneously added to the Solution No. 1 over a period of 90 seconds, and the mixture was then ripened at 45° C for 1 minute. Thereafter, Solution No. 4 was added thereto, and ripening was effected at 45° C for 20 minutes. Next, 235 g (on a dry basis) of inert gelatin was added, followed by ripening at 45° C for 15 minutes. The resulting emulsion was cooled and permitted to set, and the soluble salts were washed from the emulsion with water. Finally, 150 cc of a 10% potassium chloride aqueous solution was added, and water was added to make the total volume to 4½ liters.

The thus prepared emulsion was divided into four portions. To three portions of the emulsion, the Compounds 4, 9, and 12 described above were respectively added in an amount of 80 mg per mol of silver, and they are hereinafter referred to as Emulsions A, B and C, respectively. To the other emulsion portion, no fogging agent was added, and it is hereinafter referred to as Emulsion D. Emulsions A to D were respectivey coated on cellulose triacetate films (at a silver coverage of 4 g/m$^2$) to produce Light-Sensitive Elements A to D, respectively. After exposure through an optical wedge for one second, the light-sensitive elements were developed in the following developer at 20° C for 4 minutes.

| Developer Composition | |
|---|---|
| N-Methyl-p-aminophenol Sulfate | 5 g |
| Hydroquinone | 10 g |
| Sodium Sulfate | 75 g |
| Sodium Metaphosphate | 30 g |
| Sodium Hydroxide | 10 g |
| Phenylhydrazine Hydrochloride | 0.2 g |
| Benzotriazole | 0.02 g |
| Water | 1 liter |

After development, the light-sensitive elements were fixed in a conventional manner to obtain reversal images.

The maximum density, minimum density and $\gamma$ value obtained for each of the elements are shown in the following table.

| Light-Sensitive Element | Dmax | Dmin | $\gamma$ |
|---|---|---|---|
| A | 1.65 | 0.21 | 1.66 |
| B | 1.73 | 0.18 | 1.58 |
| C | 1.69 | 0.27 | 1.61 |
| D | 0.06* | 0.07** | — |

*The density at the unexposed portions.
**The density at the most highly exposed portions, which becomes higher than that at the unexposed portions due to the formation of a negative image.

As described above, the quaternary salt fogging agents of this invention acted as a highly efficient nucleus-forming agent in the direct reversal emulsion and provided satisfactory reversal images.

While the invention has been described in detail and with reference to specific embodiments thereof, it will be apparent to one skilled in the art that various changes and modifications can be made therein without departing from the spirit and scope thereof.

What is claimed is:

1. A direct positive silver halide photographic light-sensitive material comprising a support having thereon at least one silver halide emulsion layer of the internal latent image type which is capable of forming a direct positive image, in which at least one hydrophilic colloid layer thereof contains at least one heterocyclic quaternary salt compound represented by the following general formula (I)

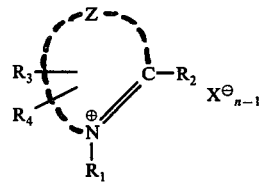

(I)

wherein Z represent an atomic group necessary for forming a thiazole nucleus, a benzothiazole nucleus, a naphthothiazole nucleus, a benzoselenazole nucleus, an oxazole nucleus, a benzoxazole nucleus, a naphthoxazole nucelus, a benzimidazole nucleus, a pyridine nucleus, a quinoline nucleus or an indolenine nucelus, $R_1$ represents an aliphatic hydrocarbon group, $R_2$ represents a hydrogen atom or an aliphatic hydrocarbon group, $R_3$ and $R_4$, which are the same or different, each represents a hydrogen atom, a halogen atom, an aliphatic hydrocarbon group, an alkoxy group, a hydroxy group or an aromatic hydrocarbon group, and at least one of $R_1$, $R_2$, $R_3$ and $R_4$ represents a propargyl group, a butynyl group, a propargyloxymethyl group, a propargyloxyethyl group or a propargyloxy group, $X^{\ominus}$ represents an anion, and $n$ is 1 or 2, with $n$ being 1 when the compound forms an inner salt; in such an amount as to exert a fogging effect on the silver halide emulsion of the internal latent image type during development.

2. The direct positive silver halide photographic light-sensitive material as claimed in claim 1, wherein the silver halide emulsion layer of the internal latent image type or a hydrophilic colloid layer adjacent thereto contains the heterocyclic quaternary salt compound represented by the general formula (I).

3. The direct positive silver halide photographic light-sensitive material as claimed in claim 2, wherein $R_1$ in the general formula (I) represents a propargyl group or a 3-butynyl group.

4. The direct positive silver halide photograhic light-sensitive material as claimed in claim 2, wherein $R_2$ in the general formula (I) represents a propargyloxymethyl group or a propargyloxyethyl group.

5. The direct positive silver halide photograhic light-sensitive material as claimed in claim 2, wherein $R_3$ in the general formula (I) represents a propargyloxy group.

6. The direct positive silver halide photograhic light-sensitive material as claimed in claim 2, wherein $R_2$ in the general formula (I) represents a propargyloxymethyl group.

7. The direct positive silver halide photographic light-sensitive material as claimed in claim 2, wherein the compound represented by the general formula (I) is present in the silver halide emulsion layer of the internal latent image type.

8. The direct positive silver halide photographic light-sensitive material as claimed in claim 3, wherein the nucleus formed by Z is a benzothiazole nucleus, a naphthothiazole nucleus, a benzoselenazole nucleus, a benzimidazole nucleus, a pyridine nucleus or a quinoline nucleus.

9. The direct positive silver halide photograhic light-sensitive material as claimed in claim 3, wherein the compound represented by the general formula (I) is present in the silver halide emulsion layer of the internal latent image type.

10. The direct positive silver halide photographic light-sensitive material as claimed in claim 4, wherein the nucleus formed by Z is a benzothiazole nucleus, a naphthothiazole nucleus or a benzoselenazole nucleus.

11. The direct positive silver halide photographic light-sensitive material as claimed in claim 5, wherein the compound represented by the general formula (I) is present in the silver halide emulsion layer of the internal latent image type.

12. The direct positive silver halide photographic light-sensitive material as claimed in claim 5, wherein the nucleus formed by Z is a benzothiazole nucleus or a benzoselenazole nucleus.

13. The direct positive silver halide photograhic light-sensitive material as claimed in claim 6, wherein the compound represented by the general formula (I) is present in the silver halide emulsion layer of the internal latent image type.

14. The direct positive silver halide photographic light-sensitive material as claimed in claim 6, wherein the nucleus formed by Z is a benzothiazole nucleus, a naphthothiazole nucleus or a benzoselenazole nucleus.

15. The direct positive silver halide photographic light-sensitive material as claimed in claim 7, wherein the nucleus formed by Z is a benzothiazole nucleus, a naphthothiazole nucleus, a benzoselenazole nucleus, a benzimidazole nucleus, a pyridine nucleus or a quinoline nucleus.

16. The direct positive silver halide photographic light-sensitive material as claimed in claim 8, wherein the compound represented by the general formula (I) is present in the silver halide emulsion layer of the internal latent image type.

17. The direct positive silver halide photographic light-sensitive material as claimed in claim 9, wherein the compound represented by the general formula (I) is 3-propargylbenzothiazolium bromide, 5,6-dimethyl-3-propargylbenzothiazolium bromide, 5-methoxy-6-methyl-3-propargylbenzothiazolium bromide, 2-methyl-3-propargylbenzothiazolium bromide, 5-chloro-2-methyl-3-propargylbenzothiazlium bromide, 2-methyl-6-methoxy-3-propargylbenzothiazlium bromide, 2-methyl-3-propargylnaphtho[1,2-d]thiazolium bromide, 2-methylthio-3-propargylbenzothiazolium bromide, 2-methyl-3-propargyl-5-propargyloxybenzothiazolium bromide, 1,4-bis(3-propargylbenzothiazlium-2)butane dibromide, 2-ethyl-3-propargylbenzothiazolium bromide, 2-methyl-6-α-naphthylmethoxy-1-propargylquinolinium bromide, 2,6-dimethyl-3-propargylbenzothiazolium bromide, 5,6-dichloro-1-ethyl-2-methyl-3-propargylbenzimidazolium bromide, 2-propyl-3-propargylbenzothiazolium bromide, 3-(3-butynyl)benzothiazlium thiocyanate, 2,4-dimethyl-3-propargylthiazolium bromide, 2-methoxy-4-methyl-3-propargylthiazolium bromide, 2-methyl-3-propargylthiazolinium iodide, 2,4-dimethyl-3-propargyloxazolium iodide, 2,5-methyl-4-carbomethoxy-3-propargyloxazolium iodide, 2-methyl-4-phenyl-3-propargyloxazolium iodide, 2-methyl-4,5-diphenyl-3-propargyloxazolium iodide, 2-methyl-5-phenyl-3-propargylbenzoxazlium bromide, 2-methyl-5-trifluoromethyl-3-propargylbenzoxazolium bromide, 2-methyl-5-chloro-3-propargylbenzoxazolium bromide, 2,3,3-trimethyl-1-propargylindoleninium chloride, 2-methyl-1-propargylpyridinium chloride, 2-methyl-3-propargylbenzoselenazolium bromide, 2-methyl-3-propargyl-5-propargyloxybenzoselenazolium bromide or 5-methyl-1-propargyltetrazolium bromide.

18. The direct positive silver halide photographic light-sensitive material as claimed in claim 10, wherein the compound represented by the general formula (I) is present in the silver halide emulsion of the internal latent image type.

19. The direct positive silver halide photographic light-sensitive material as claimed in claim 11, wherein the compound represented by the general formula (I) is 2-methyl-3-propargyl-5-propargyloxybenzothiazolium bromide, 2,3-dimethyl-5-propargyloxybenzothiazolium iodide, anhydro-2-methyl-5-propargyloxy-3-sulfopropylbenzothiazolium bromide, 2-methyl-5-propargyloxy-3-propylbenzothiazolium chloride or 2-methyl-3-propargyl-5-propargyloxybenzoselenazolium bromide.

20. The direct positive silver halide photographic light-sensitive material as claimed in claim 12, wherein the compound represented by the general formula (I) is present in the silver halide emulsion layer of the internal latent image type.

21. The direct positive silver halide photographic light-sensitive material as claimed in claim 13, wherein the compound represented by the general formula (I) is 3-methyl-2-propargyloxymethylbenzothiazlium iodide, 3-propyl-2-propargyloxymethylbenzothiazolium chloride or 2-propargyloxymethyl-3-methylbenzoselenazolium bromide.

22. The direct positive silver halide photographic light-sensitive material as claimed in claim 14, wherein the compound represented by the general formula (I) is present in the silver halide emulsion layer of the internal latent image type.

23. The direct positive silver halide photographic light-sensitive material as claimed in claim 15, wherein the nucleus formed by Z is a benzothiazole nucleus, a naphthothiazole nucleus or a benzoselenazole nucleus.

24. The direct positive silver halide photographic light-sensitive material as claimed in claim 16, wherein the nucleus formed by Z is a benzothiazole nucleus, a naphthothiazole nucleus or a benzoselenazole nucleus.

* * * * *